US007704166B2

(12) United States Patent
Lim

(10) Patent No.: US 7,704,166 B2
(45) Date of Patent: Apr. 27, 2010

(54) GOLF TEE

(76) Inventor: E T Lim, Blk 209 Tampines Street 21 #03-1333, Singapore (SG) 1852

( * ) Notice: Subject to any disclaimer, the term of this patent is extended or adjusted under 35 U.S.C. 154(b) by 0 days.

(21) Appl. No.: 10/568,050

(22) PCT Filed: Sep. 5, 2003

(86) PCT No.: PCT/SG03/00211

§ 371 (c)(1),
(2), (4) Date: Aug. 14, 2006

(87) PCT Pub. No.: WO2005/023381

PCT Pub. Date: Mar. 17, 2005

(65) Prior Publication Data

US 2007/0004538 A1 Jan. 4, 2007

(51) Int. Cl.
*A63B 57/00* (2006.01)

(52) U.S. Cl. ..... 473/396; 473/401

(58) Field of Classification Search ..... 473/387–403, 473/132, 137; D21/717
See application file for complete search history.

(56) References Cited

U.S. PATENT DOCUMENTS

| | | | | | |
|---|---|---|---|---|---|
| 1,551,207 | A | * | 8/1925 | Nial et. al. | 473/400 |
| 1,623,119 | A | | 4/1927 | Kearney | |
| 1,866,143 | A | * | 7/1932 | Willey | 473/397 |
| 2,198,968 | A | * | 4/1940 | Josephine | 473/137 |
| 2,457,670 | A | * | 12/1948 | Harvey | 473/397 |
| 2,573,107 | A | | 10/1951 | Morgan | |
| 2,839,304 | A | * | 6/1958 | Lerick | 473/397 |
| 3,414,268 | A | | 12/1968 | Chase | |
| 3,966,214 | A | | 6/1976 | Collins | |
| 4,004,814 | A | * | 1/1977 | Blair | 473/392 |
| 4,645,208 | A | | 2/1987 | Morabeto | |
| 4,998,732 | A | | 3/1991 | Gallant | |
| D369,845 | S | * | 5/1996 | Knez | D21/718 |
| 5,571,055 | A | * | 11/1996 | Lewis et al. | 473/398 |
| 5,613,678 | A | | 3/1997 | McKee | |
| D415,806 | S | * | 10/1999 | Wang | D21/718 |
| 6,086,486 | A | * | 7/2000 | Murphy et al. | 473/397 |
| 6,110,059 | A | * | 8/2000 | Haggarty | 473/387 |
| D488,525 | S | * | 4/2004 | Cardarelli | D21/717 |
| 2004/0018896 | A1 | * | 1/2004 | Liu | 473/387 |
| 2005/0261089 | A1 | * | 11/2005 | Homby | 473/387 |

(Continued)

FOREIGN PATENT DOCUMENTS

DE 20014825 U1 11/2000

(Continued)

OTHER PUBLICATIONS

PCT/SG03/00211 International Search Report, mailed Jun. 4, 2004.

*Primary Examiner*—Steven Wong

(57) ABSTRACT

A golf tee comprising a shaft, a stopper portion disposed at an upper end of the shaft and a pivotable support portion mounted atop the upper end of the shaft is described. The shaft is adapted for insertion into a surface of ground. The support portion has a plurality of prong members mounted upon an upper horizontal surface thereof. The position of the support portion can be adjusted so that the upper surface of the support portion is arranged in parallel horizontal alignment with the ground surface. The prong members are adapted to support a golf ball placed thereupon.

15 Claims, 8 Drawing Sheets

U.S. PATENT DOCUMENTS

| | | | | |
|---|---|---|---|---|
| 2006/0058120 | A1* | 3/2006 | Anton | 473/386 |
| 2007/0149324 | A1* | 6/2007 | Tsai | 473/387 |

FOREIGN PATENT DOCUMENTS

| | | | | |
|---|---|---|---|---|
| FR | 781287 | A | | 5/1935 |
| GB | 191329794 | A | | 6/1914 |
| GB | 236132 | A | | 7/1925 |
| GB | 2258161 | A | * | 2/1993 |
| JP | 51068330 | A | | 6/1976 |
| WO | WO 94/15679 | A | | 7/1994 |

* cited by examiner

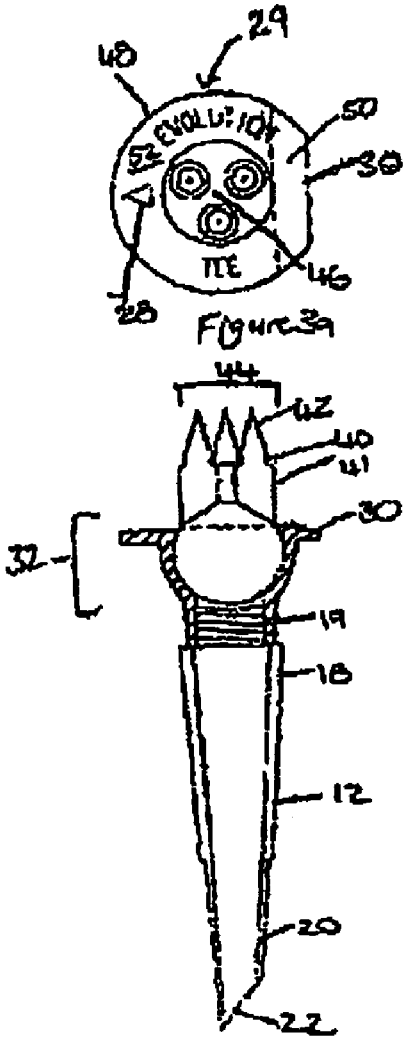
Figure 3a
Figure 3b
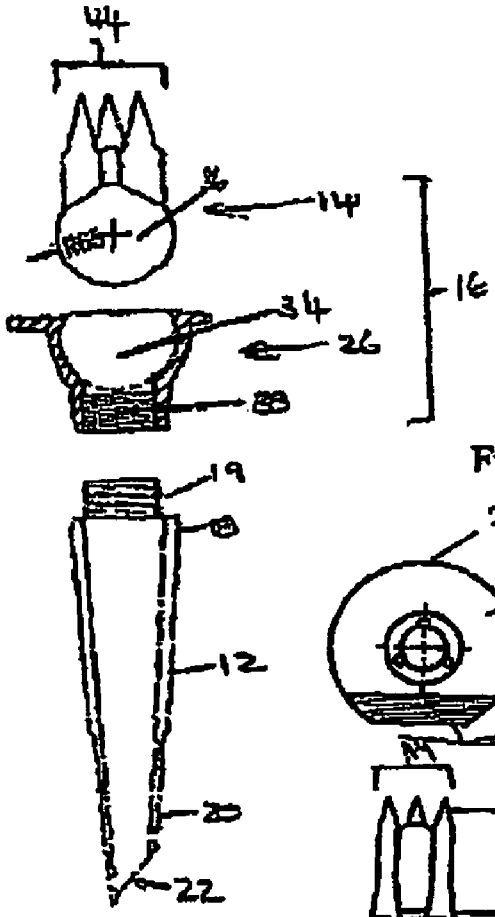
Figure 3c
Figure 3d
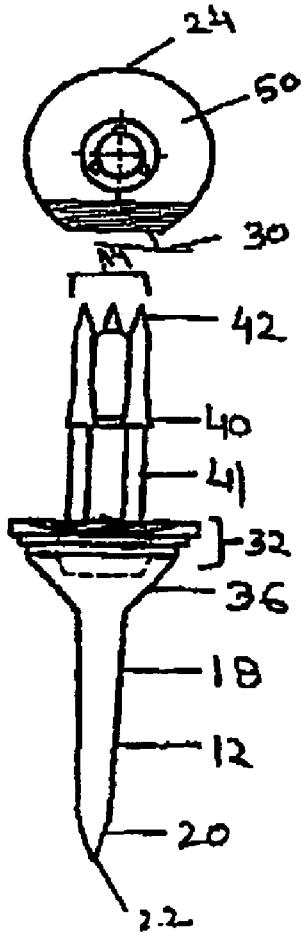
Figure 3e

GOLF TEE

This application is a National Stage of International Application PCT/SG2003/000211, filed Sep. 5, 2003, published Mar. 17, 2005, under PCT Article 21(2) in English.

FIELD OF THE INVENTION

The present invention relates to a golf tee.

BACKGROUND OF THE INVENTION

Golf tees comprising an inflexible shaft with a substantially bowl-shaped support surface, upon which a golf ball is balanced, are known. It may be difficult to balance a golf ball upon such golf tees, detracting from the ability of a golfer to strike the ball in a fashion that affords the best drive possible. Difficulties in balancing the ball may be particularly enhanced where the playing surface is irregular. Further, it is theorized that the amount of surface contact necessary between the ball and the tee may hinder the distance of the drive when the ball is struck by a golf club in the known manner of play.

Such known golf tees may also be difficult to remove from the ground after a shot has been played from the tee. This difficulty may be enhanced in situations where the playing ground is hard and dry.

The present invention attempts to overcome at least in part the aforementioned disadvantages of previous golf tees.

SUMMARY OF THE INVENTION

In accordance with one aspect of the present invention there is provided a golf tee 10, characterised by a shaft 12 adapted for insertion into a surface of ground, and a pivotable support portion 16 mounted atop an upper end 18 of the shaft 12, the pivotable support portion 16 haying a plurality of upright prong members 40 mounted thereupon, the prong members 40 being arranged to support a golf ball placed atop the prong members 40 such that the golf ball is positioned substantially above the upright prong members 40 and the pivotable support portion 16 is pivotable relative to a longitudinal axis of the shaft 12 so as to assist in balancing the golf bail atop the prong members 40.

In accordance with a second aspect of the present invention there is provided a golf tee 110, the golf tee 110 characterised by a base portion 13 having at least one cavity and at least one shaft 12 with a pivotable support portion 16 arranged atop the shaft 12, the pivotable support portion 16 having a plurality of prong members 40 mounted thereupon, the shaft 12 being pivotable relative to the base portion 13 between a first position in which the shaft 12 and prong members 40 are substantially upright and the prong members 40 are arranged to support a golf ball placed atop the prong members 40 such that the golf ball is positioned substantially above the upright prong members 40 and the pivotable support portion 16 is pivotable relative to a longitudinal axis of the shaft 12 so as to assist in balancing the golf ball atop the upright prong members 40; and a second position in which die shaft 12, support portion and prong members 40 are disposed Substantially within the cavity 15.

DESCRIPTION OF AN EMBODIMENT OF THE INVENTION

The present invention will now be described, by way of example, with reference to the accompanying drawings, in which:

FIG. 1 is a aide elevation view of a golf tee in accordance with the present invention;

FIG. 2*a* is a plan view of a second embodiment of a golf tee of the present invention;

FIG. 2*b* is a longitudinal cross section of the golf tee of FIG. 2*a;*

FIG. 2*c* is an exploded longitudinal cross section of the golf tee of FIG. 2*b;*

FIG. 2*d* is a plan view of a second embodiment of a golf tee of the present invention, wherein the support portion is mounted on the shaft;

FIG. 2*e* is a longitudinal cross section of the golf tee of FIG. 2*d;*

FIG. 3*a* is a plan view of the golf tee of FIG. 1;

FIG. 3*b* is a longitudinal cross section of the golf tee of FIG. 1;

FIG. 3*c* is an exploded longitudinal owes section of the golf tee of FIG. 1;

FIG. 3*d* is a plan view of a third embodiment of a golf tee of the present invention, wherein the support portion is mounted on the shaft;

FIG. 3*e* is a longitudinal cross section of the golf tee of FIG. 3*d;*

FIG. 4*a* is a plan view of a third embodiment of a golf tee of the present invention;

FIG. 4*b* is a longitudinal cross section of the golf tee of FIG. 4*a;*

FIG. 4*c* is an exploded longitudinal cross section of the golf tee of FIG. 4*b*; and FIG. 4*d* is a plan view of a third embodiment of a golf tee of the present invention, wherein the support portion is mourned on the shaft;

FIG. 4*e* is a longitudinal cross section of the golf tee of FIG. 4*d;*

Figure 1:
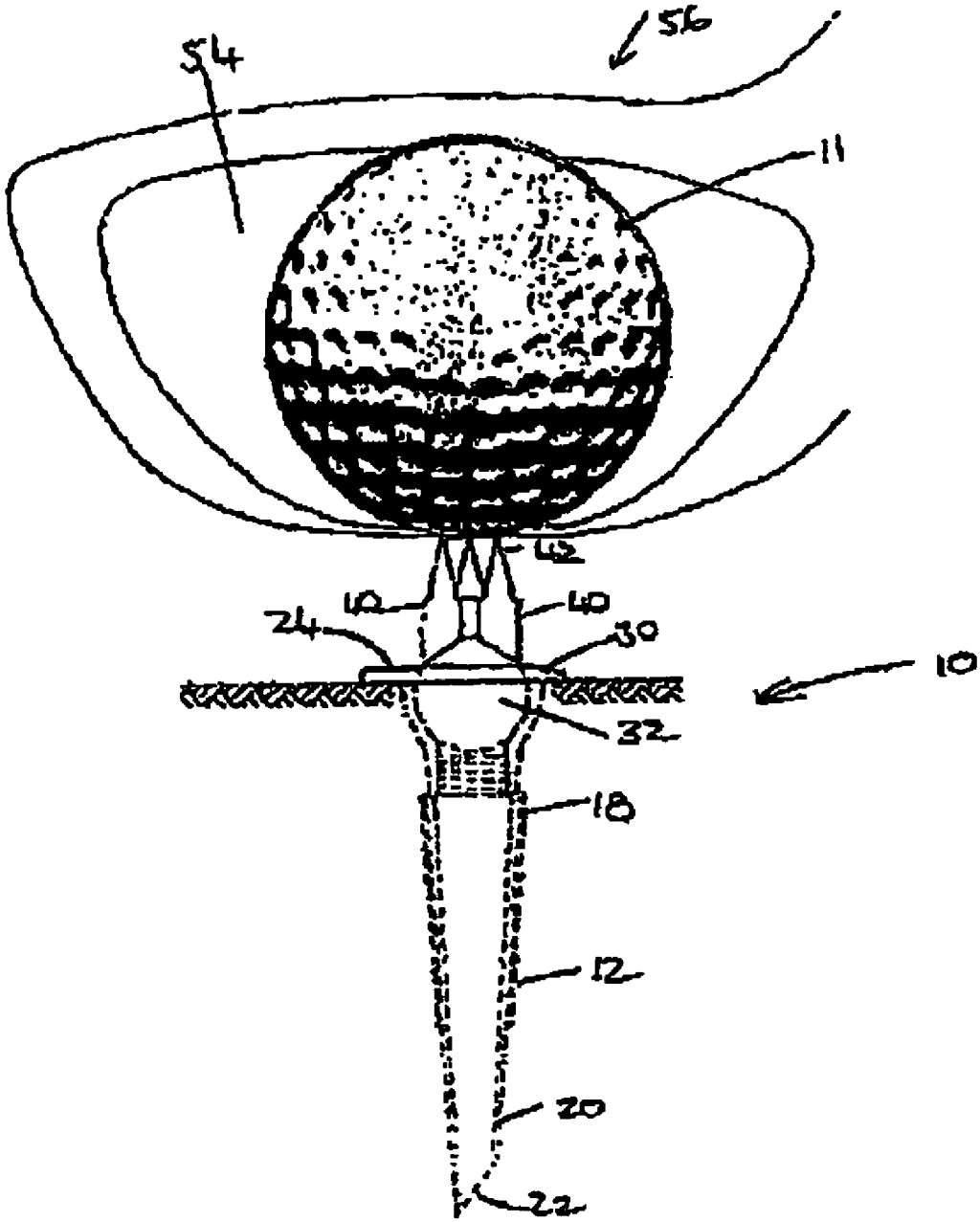
Figure 2A:
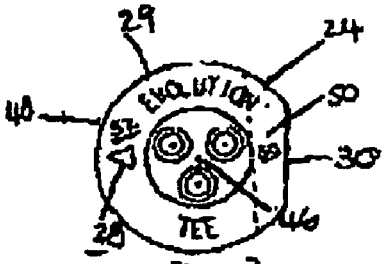
Figure 2B:
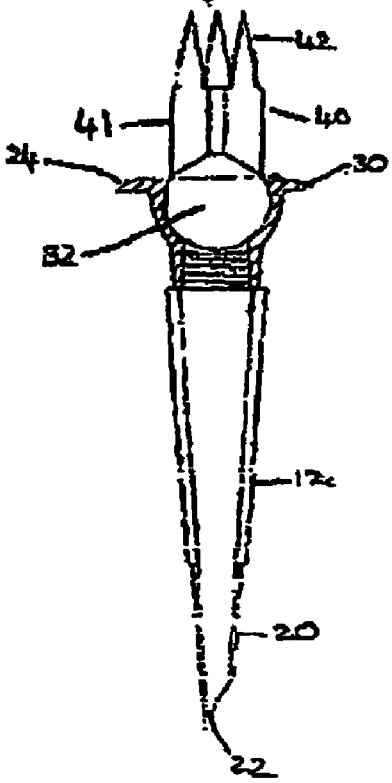
Figure 2C:
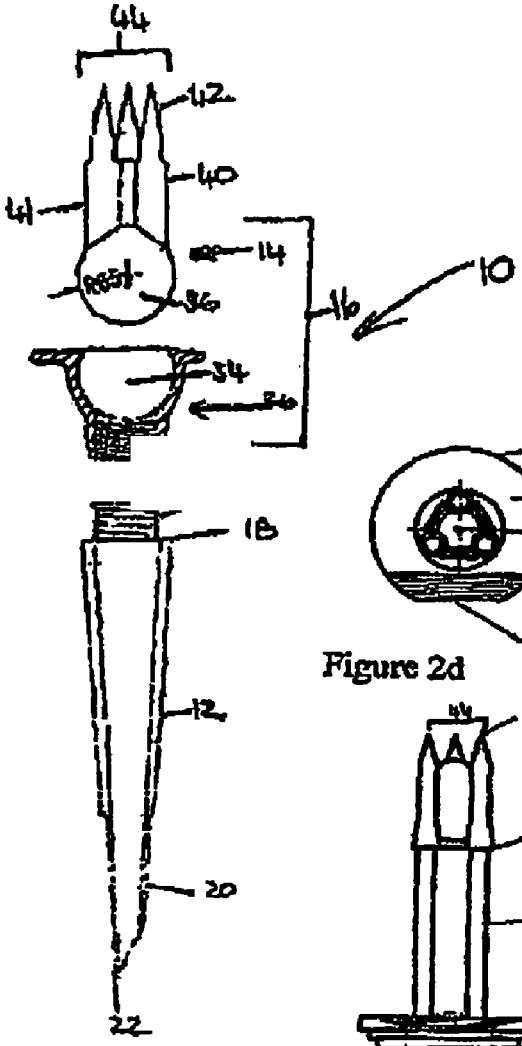
Figure 2D:
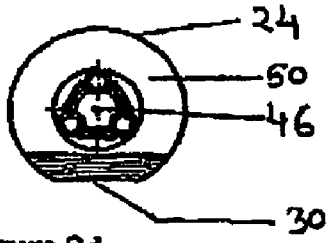
Figure 2E:
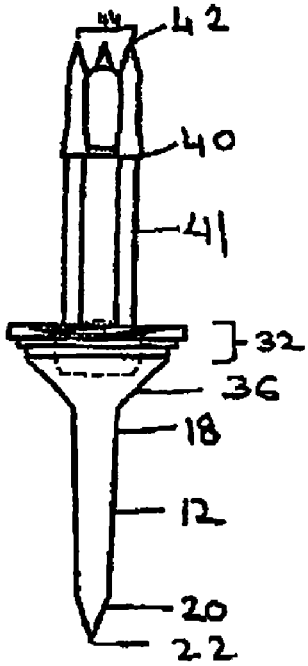
Figure 4A:
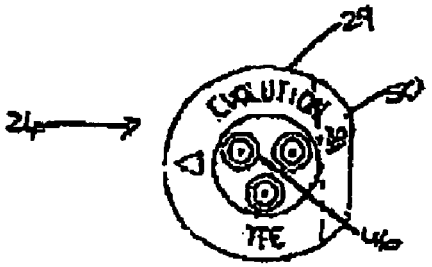
Figure 4B:
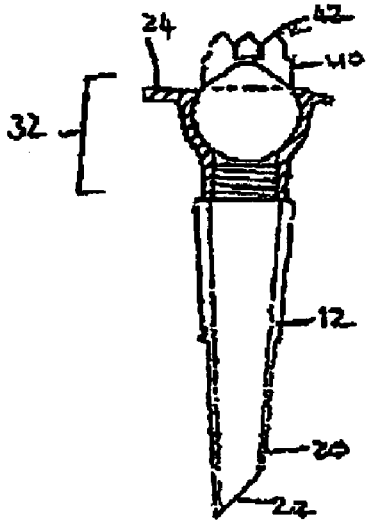
Figure 4C:
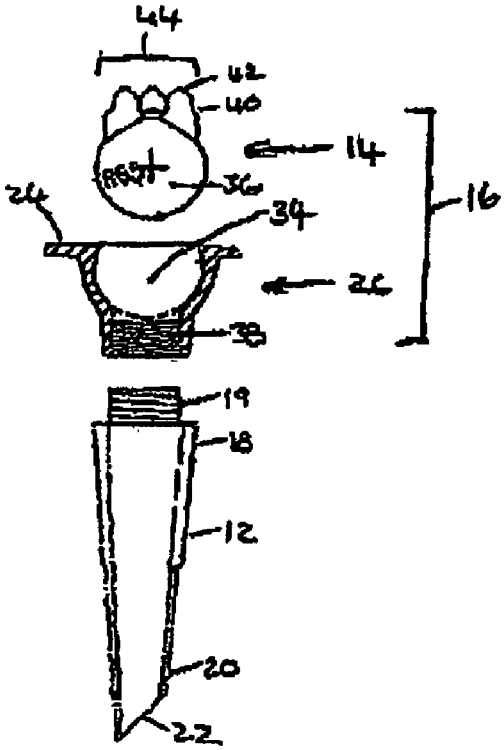
Figure 4D:
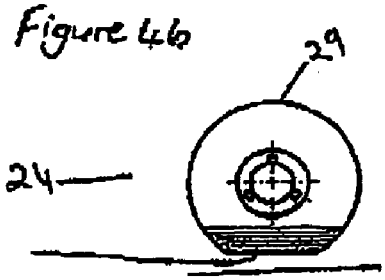
Figure 4C:
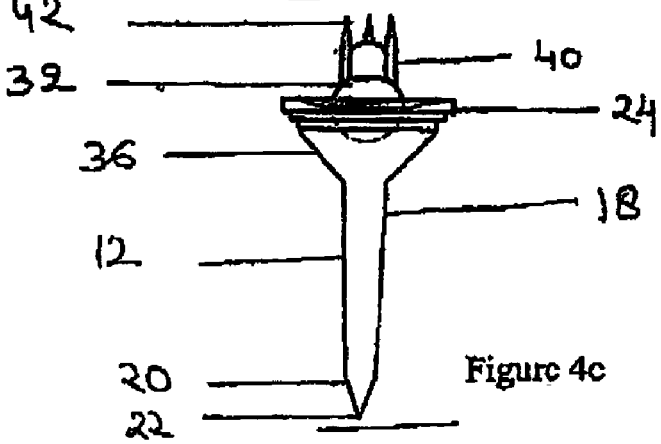
Figure 5:
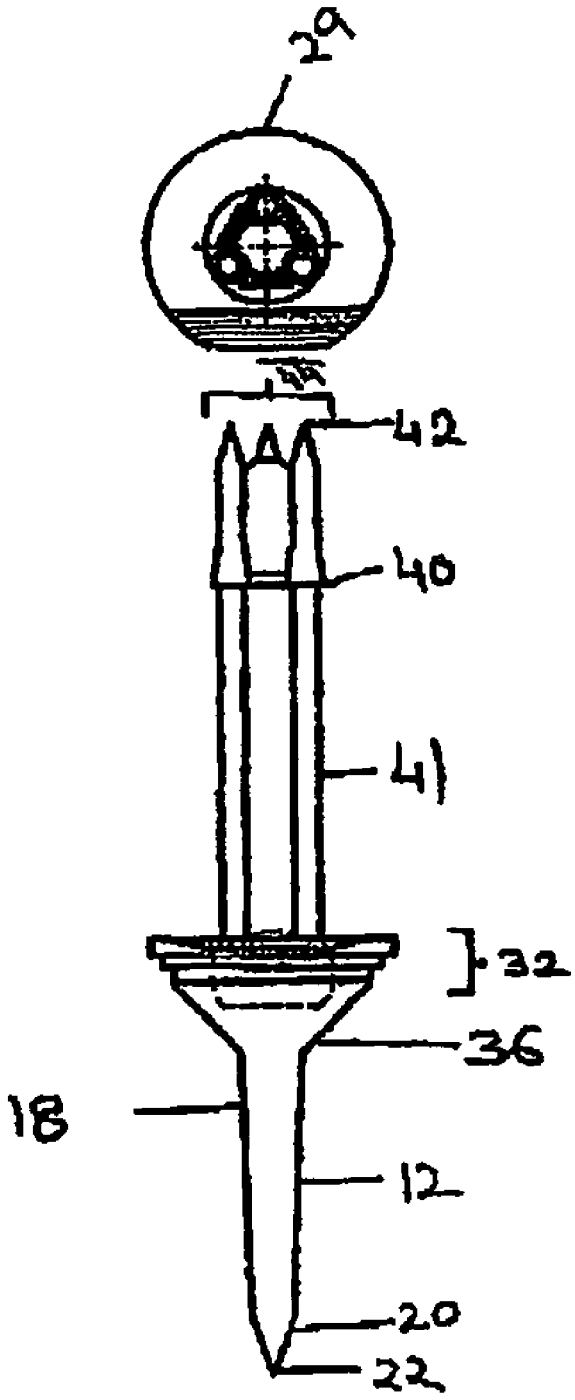
FIG. 5 is a longitudinal cross section of golf tee with tong prong members and interconnects.
Figure 6:
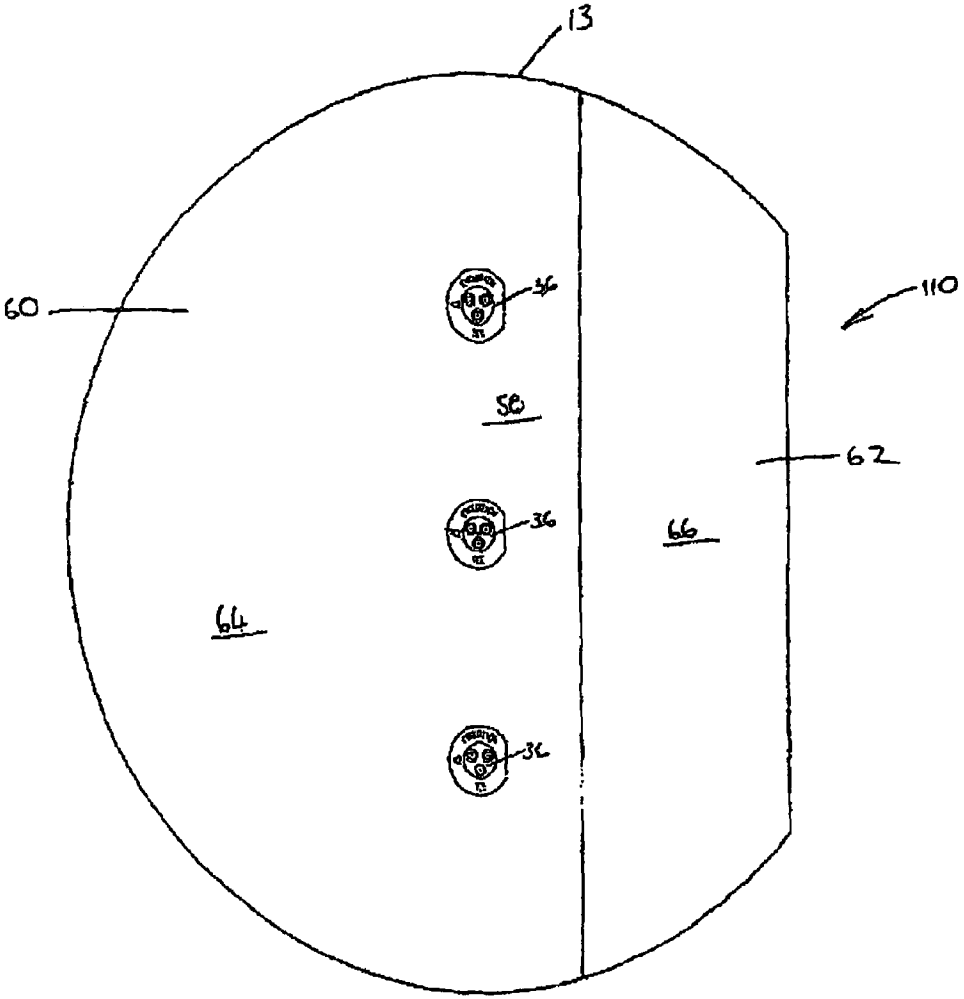
FIG. 6 is a plan view of a fourth embodiment of a golf tee in accordance with the present invention.
Figure 7:
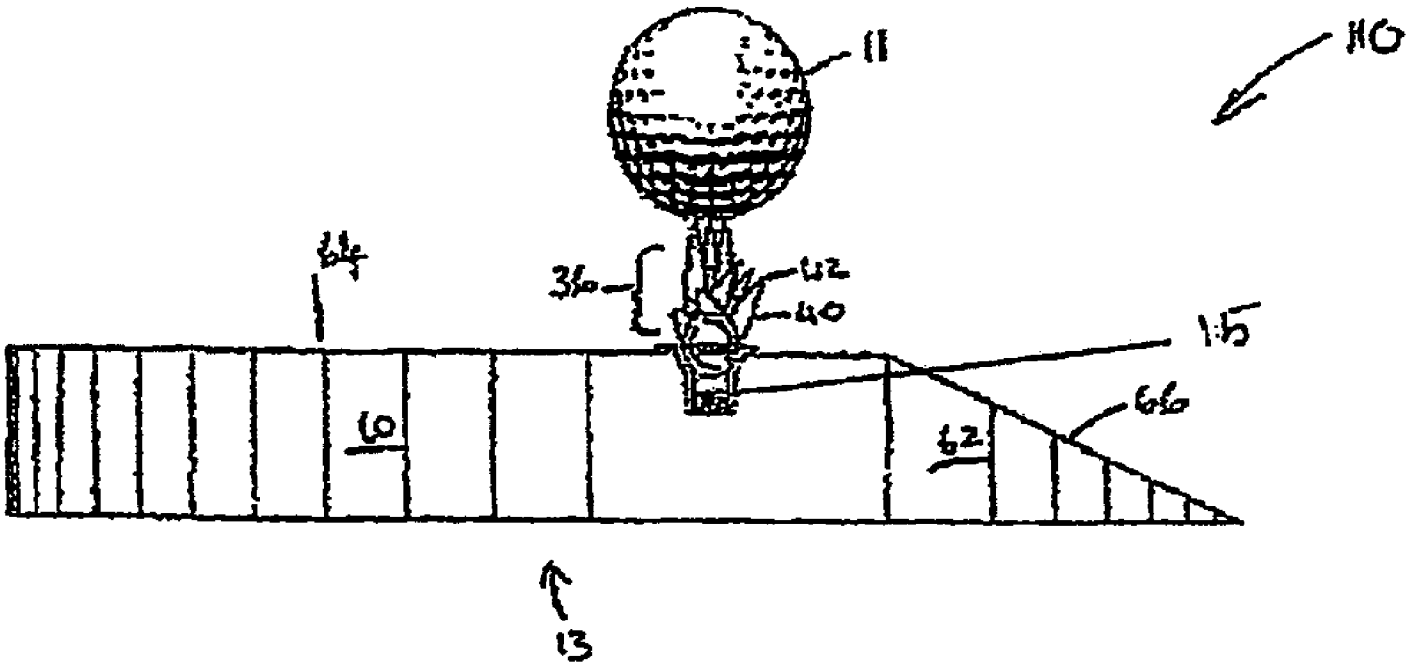
FIG. 7 is a side cross section of the fourth embodiment of the golf tee of FIG. 6
Figure 8:
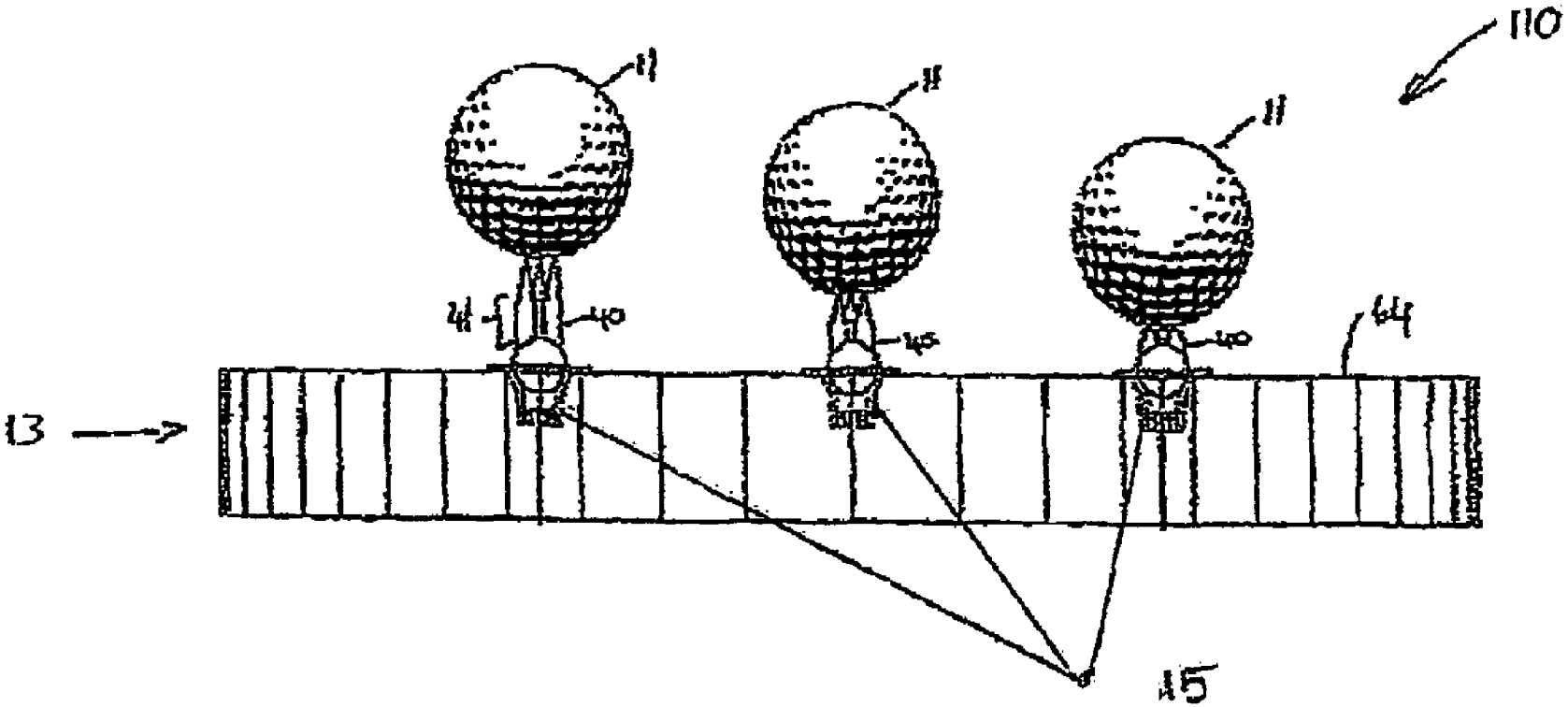
FIG. 8 is a front cross section of the fourth embodiment of the golf tee of FIG. 6.

Referring to the Figures, where like parts are denoted by like numerals in different embodiments, there is shown a golf tee 10 comprising a shaft 12, a pivotable support portion 16 disposed atop an upper end 18 of the shaft, a stopper portion 24 disposed adjacent the pivotable support portion 16 and a plurality of upright prong members 40. The shaft 12 is an elongate member, having an upper end 18 and a lower end 20. The upper end 18 is provided with a threaded portion 19. The shaft 12 is tapered at the 15 lower end 18 to form a pointed portion 22. The shaft 12 with printed portion 22 is adapted for insertion into a surface of ground. The threaded portion 19 of the upper end 18 of the shaft 12 is adapted to receive the pivotable support portion 16. The pivotable support portion 16 it comprised of an upper portion 14 and a lower portion 26. The upper portion 14 and lower portion 26 are connected by a pivotable connection means 32.

The lower portion 26 of the pivotable support portion 16 includes a threaded portion 38, disposed at a lower end thereof. The threaded portion 38 is complementary to the threaded portion 19 at the upper end 18 of the shaft 12. The threaded portions 19, 38 of the shaft 12 and lower portion 26 of the pivotable support portion 16 are adapted to be threadingly engaged with each other.

The pivotable connection means 32 is preferably in the form of a ball and socket assembly. To this extent, the lower portion 26 of the pivotable support portion 16 is provided with a socket 34. The socket 34 is substantially concave in configuration. The upper portion 14 of the pivotable support portion 16 includes a pivotable portion 36. The pivotable portion 36 is substantially spherical in configuration. The socket 34 of the lower portion 26 of the pivotable support portion 16 is adapted in use, to engagingly receive the pivotable portion 36 of the upper portion 14 of the pivotable support portion 16. The socket 34 is therefore complementary in configuration to the pivotable portion 36.

The pivotable connection means 32 permits the pivotable support portion 16 to be pivotably rotated about the upper end 18 of the shaft 12.

The stopper portion 24 is disposed atop the lower portion 26 of the pivotable support portion 16. The stopper portion 24 comprises a substantially annular flange 29, truncated at one side to form a C-shaped portion 48 and a segmented portion 50. The C-shaped portion 48 has an upper surface 52. The upper surface 52 is substantially horizontal. The segmented portion 50 has an upper sloping surface 30. The upper sloping surface 30 extends downwardly from the upper surface 52 of the C-shaped portion 48. Preferably, the sloping surface 30 has a gradient of 25° to the horizontal. The sloping surface 30 is arranged in use, to face towards a striking surface 54 of a golf club 56. In this manner, the provision of the sloping surface 30 ensures that the stopper portion 24 is not displaced upon the golf ball 11 being struck by the golf club 56 in play.

The stopper portion 24 is provided to limit the depth to which the shaft 12 of the golf tee 10 can be inserted into the ground surface. The stopper portion 24 is adapted to lie contiguously with the ground surface in use. In this manner, the stopper portion 24 abuts the ground surface, providing a stabilizing surface, which imparts greater stability to a golf ball, when placed atop the golf tee 10. Optionally, the stopper portion 24 maybe provided with a plurality of leg portions (not shown), extending downwardly from a lower surface of the stopper portion 24. The provision of leg portions enables the golf tee to be more readily removed from the ground by pulling the stopper portion 24 upwardly.

The stopper portion 24 further includes a guidance marker 28. The guidance marker 28 is disposed on an upper surface of the stopper portion 24, diametrically opposite the sloping portion 30. The guidance marker 28 is preferably in the form of a line or arrow, painted or otherwise marked upon the upper surface 52 of the stopper portion 24. The guidance marker 28 is in use, arranged to point in the direction in which the golf ball atop the golf tee 10 is desired to travel.

A plurality of substantially vertical prong members 40 are mounted atop the upper portion 36 of the pivotable portion 14 of the pivotable support portion 16. Preferably, three prong members 40 are mounted atop the pivotable support portion 16.

The longitudinal length of the plurality of prong members 40 may vary from one golf tee 10 to another golf tee 10 to suit particular intended golf strokes. For example, if it is desired to play a shot in which a great distance is to be achieved, a golf tee 10 having prong members 40 that are relatively long in longitudinal length would be desirable. However, for a shot in which the distance travelled by the ball is not intended to be so great, a golf tee 10 having relatively shorter prong members 40, such as is shown in FIGS. 3 and 4, would be desirable.

However, the longitudinal length of the prong members 40 on any single golf tee 10 in accordance with the present invention must be the same. For example, in one embodiment, as seen in FIG. 2, the golf tee 10 has prong members 40 that are greater in longitudinal length relative to the prong members 40 provided upon the golf tees shown in FIGS. 3 and 4. The golf tee 10 shown in FIG. 3, has prong members 40 that are greater in longitudinal length relative to the prong members 40 of the golf tee 10 of the embodiment as seen in FIG. 4.

Each prong member 40 extends upwardly from the pivotal portion 36 of the support portion 16, terminating in a pointed portion 42. Each pointed portion 42 is substantially conical in configuration, wherein an apex of the pointed portion 42 is arranged to point upwardly.

The prong members 40 are arranged upon the pivotal portion 36 of the support portion 16 in a substantially triangular configuration, with a space 46 therebetween. Preferably, the prong members 40 are equidistantly and equiangularly spaced upon the pivotal portion 36 of the support portion 16. In this arrangement, the pointed portions 42 atop each prong member 40 form a substantially equilateral triangular support surface 44, which supports a golf ball placed thereupon. The configuration of each pointed portion 42 is such that the support surface 44 has minimal contact with the golf ball thereupon.

The prong members 40 upon the pivotal portion 36 of the support portion 16 are arranged in relatively close proximity to each other. The close proximity of the prong members 40 is such that the golf ball placed thereupon, when resting atop the pointed portions 42 of the prong members 40, does not distend into the space 46 between the prong members 40, as seen in FIG. 1. In this manner, the golf ball 11 placed upon the prong members 40 is elevated in use, with minimal surface area of the golf ball 11 disposed below the pointed portions 42 of each prong member 40. It is envisaged that the combination of minimal surface contact between the golf ball 11 and the pointed portions 42, together with the elevated arrangement of the golf ball 11 thereupon will assist a golfer to urge the golf ball to a greater distance after contact with a golf club in the known method of playing golf.

In the first two embodiments of the present invention, as shown in FIGS. 2 and 3, the prong members 40 have an interconnected portion 41 at ends proximal to the pivotal portion 36 of the support portion 16, in which lower ends of the prong members 40 are longitudinally connected. The interconnected portion 41 of the prong members 40 acts to maintain the prong members 40 in a substantially vertical arrangement upon the pivotal portion 36 of the support portion 16. In this manner, the pointed portions 42 of each prong member 40 are maintained in substantially horizontal alignment with one another, thus sustaining the support surface 44 that is best able to support and balance the golf ball placed thereupon as previously described.

In the third embodiment of the present invention, seen in FIG. 4, the prong members 40 are shorter in longitudinal length relative to that of the golf tees 10 shown in FIGS. 2 and 3. In this regard, shorter prong members 40 are less likely to diverge from their vertical arrangement than the longer prong members 40 of the first and second embodiments and therefore, the prong members 40 are not provided with an interconnected portion 41.

In use, shaft 12 and the pivotable support portion 16 are combined by threadingly engaging the threaded portions 19, 38 of the shaft 12 and lower portion 26 of the pivotable support portion 16. It should be understood that the pivotable portion 14 is provided already connected to the lower portion 26 of the pivotable support portion 16.

The shaft 12 of the golf tee 10 is inserted into the surface of ground by pushing the pointed portion 22 of the shaft 12 into the ground. The golf tee 10 is pushed downwardly into the ground until the stopper portion 24 abuts the surface of the ground, thereby preventing further downward movement of the golf tee 10.

The golf tee 10 is positioned such that the guidance marker 28 points in the direction in which it is desired to drive the golf ball atop the golf tee 10. The sloping portion 30 of the stopper portion 24 thus faces towards the striking surface 54 of the golf club 56.

The support portion 16 is then pivoted about the pivotable connection means 32 until the position of the pivotal portion 38 of the support portion 16 is such that the prong members 40 are pointed vertically upwards, regardless of the angle of the surface in which the shaft 12 of the golf tee 10 is inserted. The golf ball is then placed upon the support surface 44 provided by the pointed portions 42 of the prong members 40. The golf ball may then be struck by a golf club in any known manner in accordance with playing the game of golf.

A fourth embodiment of the present invention will now be described, wherein like parts are denoted by like numerals as hereinbefore described in the previous embodiments.

In this embodiment of the golf tee 110, the shaft 12 is replaced with a base portion 13. The base portion 13 comprises a substantially disc-shaped member 58, truncated at one side to form a first portion 60 and a second portion 62. The first portion 60 has a substantially horizontal upper surface 64. The second portion 62 has a downwardly sloping upper surface 66. Preferably, the sloping upper surface 66 has a gradient of 25° to the horizontal. The sloping upper surface 66 is arranged in use, to face towards the striking surface 54 of the golf club 56.

The first portion 60 of the base portion 13 provides a platform upon which at least one pivotable portion 36 with prong members 40 is arranged atop.

The base portion 13 is preferably provided with an anchor means (not shown) so that the base portion 13 is able to lie stably adjacent the ground surface in use. The anchor means is preferably in the form of a weight, attached below or internally of the base portion 13.

The upper surface 64 of the first portion 60 of the base portion 13 is further provided with at least one cavity 15. The cavity 15 is adapted in use to receive the pivotable portion 36 and prong members 40 when the golf tee 10 is not in use.

Preferably, the golf tee 110 is provided with three separate pivotable portions 36 with prong members 40, arranged in a row atop the first portion 60 of the base portion 13. Each individual pivotable portion 36 has prong members 40 having varying longitudinal lengths as previously described in the previous three embodiments. The cavities 15 are accordingly arranged to correspond to the varying longitudinal lengths of prong members 40.

The pivotable portions 36 with prong members 40 mounted thereto are pivotable between a first position, in which the pivotable portion 36 and prong members 16 are substantially upright, and a second position in which the pivotable portion 36 and prong members 40 are disposed substantially horizontally within the cavity 15 of the base portion 13.

In use, a golfer places the golf tee 110 upon the surface of ground and positions the pivotable portion 36 to the first position. In this position, the prong members 40 are substantially vertical and the golf ball may be placed thereupon as previously described. The selection of which particular pivotable portion 36 that will be pivoted into this position is dependant on the distance of stroke the golfer desires to take.

Upon completion of the stroke, the pivotable portion 36 with prong members 40 is pivoted into the second position, in which the pivotable portion 36 and prong members 40 are received by the corresponding cavity 15. The placement of the pivotable portion 36 and prong members 40 within the cavity 15 is such that the pivotable portion 36 and prong members 40 are substantially flush with the upper surface 64 of the first portion 60 of the base portion 13.

Modifications and variations as would be apparent to a skilled addressee are deemed to be within the scope of the present invention.

The invention claimed is:

1. A golf tee (10), characterized by a shaft (12) adapted for insertion into a surface of ground, and a pivotable support portion (16) mounted atop an upper end (18) of the shaft (12), the pivotable support portion (16) having a plurality of upright prong members (40) of equal length mounted thereupon, the prong members (40) being arranged to support a golf ball placed atop the prong members (40) such that the golf ball is positioned substantially above the upright prong members (40) and the pivotable support portion (16) is pivotable relative to a longitudinal axis of the shaft (12) so as to assist in balancing the golf ball atop the prong members (40); and a plurality of sets of prong members (40), having various longitudinal lengths, and a set of prong members (40) is selected based on the length of a desired golf shot, wherein the length of the desired golf shot is selected from the group of first length, second length and third length, wherein the first length is greater than the second length and the third length, and the second length is greater than the third length, wherein the prong members (40) have either a first longitudinal length, a second longitudinal length, or a third longitudinal length, wherein the first longitudinal length is longer than the second or third longitudinal length, and wherein the second longitudinal length is longer than the third longitudinal length, wherein the prong members (40) with the first longitudinal length are desired to play a golf shot with the first length, and the prong members (40) with the second longitudinal length are desired to play a golf shot with the second length, and the prong members (40) with the third longitudinal length are desired to play a golf shot with the third length.

2. The golf tee (10) in accordance with claim 1, characterized in that the pivotable support portion (16) has an upper portion (14) and a lower portion (26), wherein the upper portion (14) includes a pivotable portion (36).

3. The golf tee (10) in accordance with claim 2, characterized in that the pivotable portion (36) is pivotably mounted adjacent the upper end (18) of the shaft (12) by a pivotable connection means (32).

4. The golf tee (10) in accordance with claim 3, characterized in that the pivotable connection means (32) is ball and socket assembly.

5. The golf tee (10) in accordance with claim 2, characterized in that the lower portion (26) of the pivotable support portion (16) is provided with a socket (34), wherein the pivotable portion (36) is complementary in configuration to the socket (34), the pivotable portion (36) of the upper portion (14) being adapted to be engagingly received by the socket (34).

6. The golf tee (10) in accordance with claim 1, characterized in that the pivotable support portion (16) is threadingly engaged with the upper end (18) of the shaft (12).

7. The golf tee (10) in accordance with claim 1, characterized in that the shaft (12) is provided with a stopper portion (24) disposed adjacent to the upper end (18) of the shaft (12).

8. A golf tee (10), characterized by:

a shaft (12) adapted for insertion into a surface of ground, and a pivotable support portion (16) mourned atop an upper end (18) of the shaft (12), the pivotable support portion (16) having a plurality of upright prong members (40) of equal length mounted thereupon, the prong members (40) being arranged to support a golf ball placed atop the prong members (40) such that the golf ball is positioned substantially above the upright prong members (40) and the pivotable support portion (16) is pivotable relative to a longitudinal axis of the shaft (12) so as to assist in balancing the golf ball atop the prong members (40);

the shaft (12) is provided with a stopper portion (24) disposed adjacent to the upper end (18) of the shaft (12); and the stopper portion (24) comprises a substantially annular flange (29) that is truncated at one side to form a C-shaped portion (48) and a segment portion (50), wherein the C-shaped portion (48) has a upper surface (52) that is substantially horizontal when the golf tee is inserted into the ground, wherein the segmented portion (50) has a sloping surface (30) that slopes downward relative to the upper surface (52) of the C-shaped portion (48), whereas the sloping surface (30) of the segmented portion (50) ensures that the stopper portion (24) is not displaced when the golf ball is struck by a golf club.

9. The golf tee (10) in accordance with claim 8, characterized in that the slope of the sloping surface (30) of the segmented portion (50) relative to the upper surface (52) of the C-shaped portion (48) has a gradient of 25°.

10. The golf tee (10) in accordance with claim 8, characterized in that the stopper portion (24) is provided with a guidance marker (28), wherein the guidance marker (28) is disposed diametrically opposite a downwardly sloping surface (30), wherein the guidance marker is located on the upper surface (52).

11. The golf tee (10) in accordance with claim 1, characterized in that each pivotable support portion (16) has three prong members (40) mounted thereupon.

12. The golf tee (10) in accordance with claim 11, characterized in that each prong member (40) has a pointed portion (42) at an upper end thereof.

13. The golf tee (10) in accordance with claim 12, characterized in that each pointed portion (42) is substantially conical.

14. The golf tee (10) in accordance with claim 1, characterized in that the prong members (40) are equidistantly and equiangularly arranged upon the pivotable support portion (16), the prong members (40) forming a support surface to support a golf hall placed atop the prong members (40), whilst maintaining minimal contact between a surface of the golf ball and prong members (40).

15. The golf tee (10) in accordance with claim 1, characterized in that a longitudinal length of the plurality of prong members (40) on a single pivotable support portion (16) is substantially the same.

* * * * *